US011448983B2

(12) United States Patent
Yoshida

(10) Patent No.: US 11,448,983 B2
(45) Date of Patent: Sep. 20, 2022

(54) DEVELOPING DEVICE

(71) Applicant: HEWLETT-PACKARD DEVELOPMENT COMPANY, L.P., Spring, TX (US)

(72) Inventor: Hiroaki Yoshida, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/294,213

(22) PCT Filed: Nov. 15, 2019

(86) PCT No.: PCT/US2019/061717
§ 371 (c)(1),
(2) Date: May 14, 2021

(87) PCT Pub. No.: WO2020/149929
PCT Pub. Date: Jul. 23, 2020

(65) Prior Publication Data

US 2022/0004119 A1 Jan. 6, 2022

(30) Foreign Application Priority Data

Jan. 18, 2019 (JP) ..... JP2019-007000

(51) Int. Cl.
*G03G 15/08* (2006.01)

(52) U.S. Cl.
CPC ..... *G03G 15/0812* (2013.01); *G03G 15/0808* (2013.01); *G03G 15/0891* (2013.01)

(58) Field of Classification Search
CPC ..... G03G 15/0812; G03G 15/0808; G03G 15/0891
See application file for complete search history.

(56) References Cited

U.S. PATENT DOCUMENTS

| | | | | |
|---|---|---|---|---|
| 4,194,830 | A * | 3/1980 | Ohnuma | G03G 15/0812 399/284 |
| 5,017,967 | A * | 5/1991 | Koga | G03G 15/0806 399/265 |
| 5,995,791 | A | 11/1999 | Kawasaki | |
| 6,198,895 | B1 | 3/2001 | Tsuda et al. | |
| 6,836,629 | B2 | 12/2004 | Miyabe et al. | |
| 8,639,167 | B2 * | 1/2014 | Nakayama | G03G 15/0812 399/284 |

(Continued)

FOREIGN PATENT DOCUMENTS

| | | |
|---|---|---|
| JP | 1995003411 | 1/1995 |
| JP | 2001117339 | 4/2001 |

(Continued)

*Primary Examiner* — Ryan D Walsh
(74) *Attorney, Agent, or Firm* — Staas & Halsey LLP

(57) ABSTRACT

A developing device includes a developer roller, a stir-and-transport member, and a layer thickness regulating member. The developer roller may carry developer to a photosensitive body. The stir-and-transport member may supply the developer to the developer roller. The layer thickness regulating member is located adjacent the developer roller to remove excess developer. The layer thickness regulating member includes a guide element to direct the excess developer to the stir-and-transport member.

15 Claims, 11 Drawing Sheets

(56) References Cited

U.S. PATENT DOCUMENTS

| | | | | |
|---|---|---|---|---|
| 2002/0071697 | A1* | 6/2002 | Fujimoto | G03G 15/0822 399/254 |
| 2003/0086728 | A1* | 5/2003 | Kikuchi | G03G 15/09 399/272 |
| 2008/0298848 | A1* | 12/2008 | Lee | G03G 15/0812 399/274 |
| 2015/0037074 | A1* | 2/2015 | Lee | G03G 15/0921 399/274 |

FOREIGN PATENT DOCUMENTS

| | | | |
|---|---|---|---|
| JP | 2009069702 | A | 4/2009 |
| JP | 4943698 | | 5/2012 |
| JP | 5482543 | | 5/2014 |
| JP | 2014106373 | A | 6/2014 |

* cited by examiner

DEVELOPING DEVICE

CROSS REFERENCE TO RELATED APPLICATIONS

This application is filed under 35 U.S.C. 0.371 as a National Stage of PCT International Application No. PCT/US2019/061717, filed on Nov. 15, 2019, in the U.S. Patent and Trademark Office, which claims the priority benefit of Japanese Patent Application No. 2019-007000, filed on Jan. 18, 2019, in the Japan Patent Office. The disclosures of PCT International Application No. PCT/US2019/061717 and Japanese Patent Application No. 2019-007000 are incorporated by reference herein in their entireties.

BACKGROUND

Some developing devices for image forming apparatuses based on an electrophotographic system use a two-component developer including toner and carrier. When such developing device is operated, the developer is mixed, stirred and transported by a stir-and-transport member such that a ratio between the toner and the carrier is uniform. The transported developer is magnetically transferred onto a developer roller that is rotated, and forms a thin layer having a uniform thickness means of the layer regulating member. After that, the toner is transferred from the thin-layered developer onto a latent image on a rotating photosensitive body to develop the latent image. During such operations, mechanical stress may occur in the developing device.

DETAILED DESCRIPTION

Figure 1:
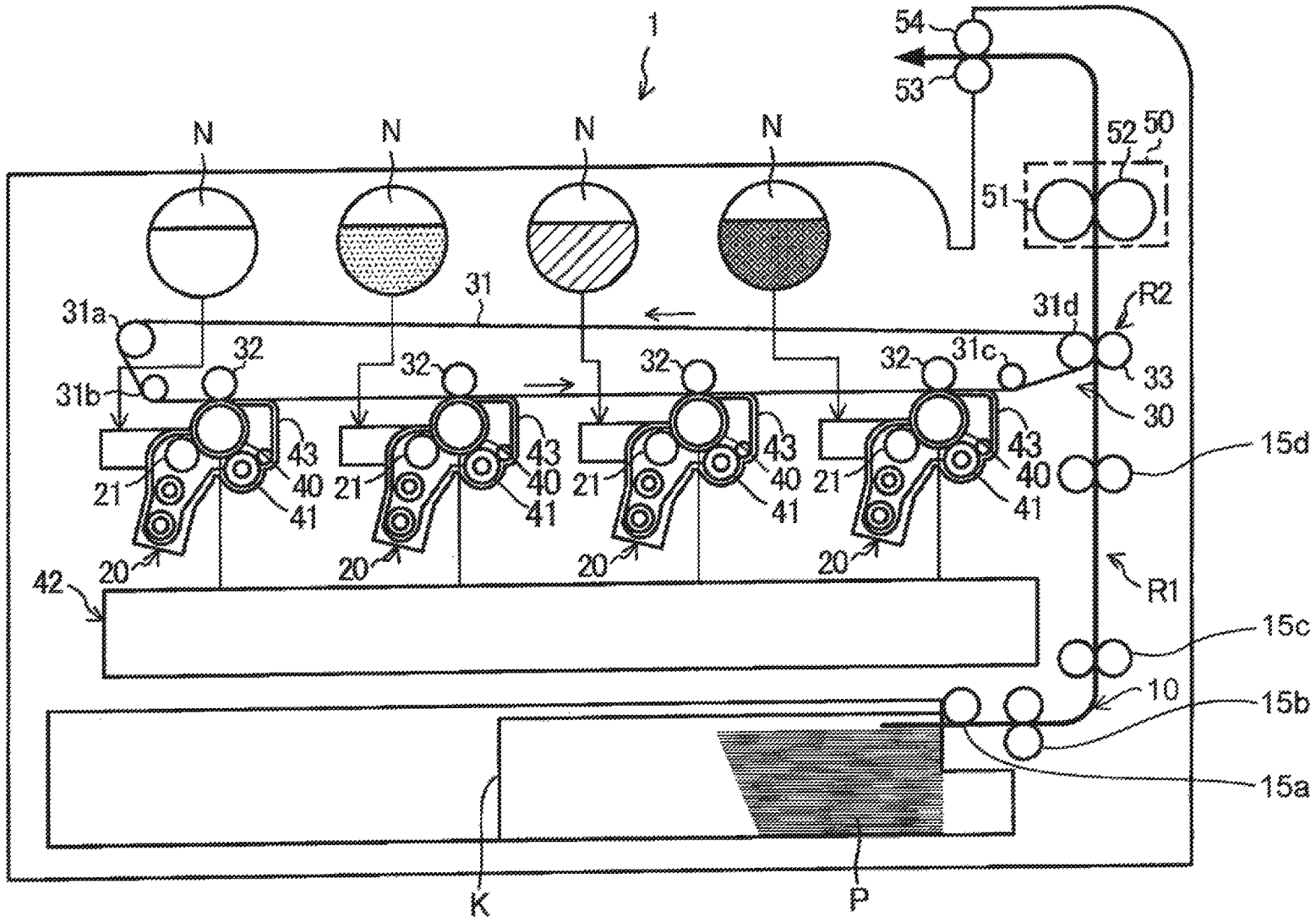
FIG. 1 is a diagram schematically showing an example image forming apparatus which may employ an example developing device.

In the following description, with reference to the drawings, the same reference numbers are assigned to the same components or to similar components having the same function, and overlapping description is omitted.

An example developing device comprises a developer roller, a rotatable stir-and-transport member to supply developer to the developer roller, and a layer thickness regulating member to remove excess (or excessive) developer so that developer adhered onto an outer circumferential surface of the developer roller is made to have a uniform thickness. The layer thickness regulating member is provided with a guide element to direct excess developer back to the stir-and-transport member. In such developing device, pressure acting on the developer can be reduced, the lodging and/or accumulating (or dwelling/cumulating) of the excess developer in the layer thickness regulating member can be prevented, and these eventually enable to reduce stress on the developer. Accordingly, an image forming apparatus provided including such developing device can attain high-speed printing, low-temperature fixing, and extended life.

In some examples, the layer thickness regulating member may include at least a first blade and a second blade disposed adjacent to each other along the outer circumferential surface of the developer roller to remove excess developer from the outer circumferential surface of the developer roller. The first blade may be positioned downstream of the second blade along a developer transport direction of the developer roller, and the second blade may be provided with an opening formed as a guide element in the second blade. In such developing device, excess developer is returned through the opening toward the stir-and-transport member, and the lodging and/or accumulating of the excess developer can be further prevented thereby.

In some examples, angles formed by respective virtual lines radially extending from the central axis of the developer roller to intersect with the respective distal edges of the first blade and the second blade and developer-regulating surfaces of the first blade and the second blade are 60 degrees or more. In such developing device, pressure acting on the developer can be further reduced, and this eventually further reduces stress on the developer.

In some examples, the opening in the second blade is positioned further away from the developer roller than an intersection point between a vertical line extending from the distal edge of the first blade to the second blade and the second blade. In such developing device, the return of excess developer toward the stir-and-transport member through the opening can be performed more efficiently.

In some examples, the developing device may comprise a third blade disposed adjacent to the second blade on an upstream side along the developer transport direction, and the third blade includes an opening positioned further away from the developer roller than an intersection point between a vertical line extending from the distal edge of the second blade to the third blade and the third blade. In such developing device, pressure acting on the developer can be further reduced, and this eventually further reduces stress on the developer.

In some examples, the guide element includes a guide body, and the guide body is provided with a hole to direct excess developer toward an upstream position along a rotation direction of the stir-and-transport member relative to the position at which the developer is supplied from the stir-and-transport member to the developer roller. In such developing device, the excess developer can be returned more efficiently toward the stir-and-transport member through the opening and the hole.

In some examples, the guide body allows the excess developer guided through the opening to drop through the hole toward the stir-and-transport member. Further, the hole in the guide body is positioned further away from the developer roller than an intersection point with a vertical line extending from the distal edge of the third blade to the guide body. In such developing device, the excess developer can be returned more efficiently toward the stir-and-transport member via the opening and the hole.

An example method comprises, in a developing device comprising a developer roller and a rotatable stir-and-transport member to supply developer to the developer roller, providing a layer thickness regulating member to remove excess developer so that developer adhered onto an outer circumferential surface of the developer roller is made to have a uniform thickness, and providing the layer thickness regulating member with a guide element to direct the excess developer back to the stir-and-transport member. Accordingly, the lodging and/or accumulating of the excess developer in the layer thickness regulating member can be prevented, pressure acting on the developer can be reduced, and these eventually enable to reduce stress on the developer. Then, image forming apparatus provided with such developing device can attain high-speed printing, low-temperature fixing, and extended life.

In some examples, the layer thickness regulating member may include at least a first blade and a second blade disposed adjacent to each other along the outer circumferential surface of the developer roller to remove excess developer from the outer circumferential surface of the developer roller, wherein the first blade is positioned downstream of the second blade along a developer transport direction of the developer roller. The method may comprise forming an opening in the second blade as a guide element. Accordingly, excess developer is returned through the opening toward the stir-and-transport member, and the lodging and/or accumulating of the excess developer can thereby be further prevented.

In some examples, the method may comprise constructing the first blade and the second blade such that angles formed by respective virtual lines radially extending from the central axis of the developer roller to intersect with the respective distal edges of the first blade and the second blade and developer-regulating surfaces of the first blade and the second blade are 60 degrees or more. Accordingly, pressure acting on the developer can be further reduced, and this eventually further reduces stress on the developer.

In some examples, the opening in the second blade is constructed such that the opening is positioned further away from the developer roller than an intersection point between a vertical line extending from the distal edge of the first blade to the second blade and the second blade. Accordingly, the return of excess developer toward the stir-and-transport member through the opening can be performed more efficiently.

In some examples, the method may comprise disposing a third blade adjacent to the second blade on the upstream side along the developer transport direction, and providing the third blade with an opening at a position further away from the developer roller than an intersection point between a vertical line extending from the distal edge of the second blade to the third blade and the third blade. Accordingly, pressure acting on the developer can be further reduced, and this eventually further reduces stress on the developer.

In some examples, the method may comprise providing a guide body as the guide element, and the guide body is provided with a hole to direct excess developer toward an upstream position along a rotation direction of the stir-and-transport member relative to the position at which the developer is supplied from the stir-and-transport member to the developer roller. Accordingly, the excess developer can be returned more efficiently toward the stir-and-transport member through the opening and the hole.

In some examples, the method may comprise providing the hole of the guide body at a position away from the developer roller than an intersection point between a vertical line extending from the distal edge of the third blade to the guide body and the guide body. Accordingly, the excess developer can be returned more efficiently toward the stir-and-transport member via the opening and the hole.

FIG. 1 schematically shows one example of an image forming apparatus 1 which may employ an example developing device. The image forming apparatus 1 may form color images using toner cartridges N of, for example, magenta, yellow, cyan and block colors. The image forming apparatus 1 may form images on paper sheets (recording media) P.

In some examples, the image forming apparatus 1 may include a recording medium conveyance unit 10 for conveying paper sheets P, developing devices 20 for developing electrostatic latent images, a transfer unit 30 for secondary transferring toner images to the paper sheets P, photosensitive bodies 40 or electrostatic latent image carriers having a circumferential surface on which images are to be formed, and a fixing unit 50 for fixing the toner images onto the paper sheets P.

The recording medium conveyance unit 10 may convey paper sheets P to be marked with images, along a conveyance path R1. The paper sheets P may be stacked and contained in a cassette K, picked up by paper feed rolls 15*a*-15*d* and conveyed. The recording medium conveyance unit 10 may convey the paper sheets P to a secondary transfer region R2 through the conveyance path R1 in such a timing that toner images to be transferred to the paper sheets P arrive at the secondary transfer region R2.

With reference to FIG. 1, four developing devices 20 may be provided, one for each of the respective colors stored in the toner cartridges N. Each of the developing devices 20 may include a developer roller 21 for carrying toner to the photosensitive body 40. Amounts of toner and carrier may be adjusted or controlled to attain a selected or target mixing ratio. The toner may be uniformly dispersed to obtain a developer imparted with an optimal amount of charge. The developer may be carried by the developer roller 21. As the developer roller 21 rotates to transport the developer to a region facing the photosensitive body 40, toner contained in the developer carried on the developer roller 21 is attracted onto an electrostatic latent image formed on the circumferential surface of the photosensitive body 40 to develop the electrostatic latent image.

The transfer unit 30 may carry the toner images formed by the developing devices 20 to the secondary transfer region R2 for a secondary transfer to the paper sheets P. The transfer unit 30 is provided with a transfer belt 31, support rollers 31*a*, 31*b*, 31*c* and 31*d* for supporting the transfer belt 31, primary transfer rollers 32 for holding the transfer belt 31 with the photosensitive bodies 40, and a secondary transfer roller 33 for holding the transfer belt with the support roller 31*d*.

The transfer belt 31 is an endless belt circularly moved by the support rollers 31*a*, 31*b*, 31*c* and 31*d*. The primary transfer rollers 32 are disposed to press against the photosensitive bodies 40 from the inner side of the transfer belt 31. The secondary transfer roller 33 is disposed to press against the support roller 31*d* from the outer side of the transfer belt 31.

With reference to FIG. 1, four photosensitive bodies 40 may be provided, one for each of the respective colors. Each of the photosensitive bodies 40 is located along the direction of movement of the transfer belt 31. Around the photosensitive body 40 are disposed, the developing device 20, a charge roller 41, an exposure unit 42 and a cleaning unit 43.

The charge roller 41 may include charge means for uniformly charging the surface of the photosensitive body 40 to a predetermined potential. The charge roller 41 may be moved to follow the rotation of the photosensitive body 40. The exposure unit 42 may expose the surface of the photosensitive body 40 charged by the charge roller 41 in accordance with an image to be formed on the paper sheets P. The potential of portions of the surface of the photosensitive body 40 exposed by the exposure unit 42 is thereby changed to form an electrostatic latent image. The four developing devices 20 develop the electrostatic latent images formed on the photosensitive bodies 40 with the toner supplied from the toner cartridges N, to create toner images. The toner cartridges N may be located opposite the respective developing devices 20, relative to the transfer belt 31. The toner cartridges N are respectively filled with magenta, yellow, cyan and black toners. The cleaning unit 43 recovers the toner remaining on the photosensitive body 40 after the toner image formed on the photosensitive body 40 has been primarily transferred onto the transfer belt 31.

The fixing unit 50 adheres and fixates onto the paper sheets P the toner image that has been secondarily transferred from the transfer belt 31 to the paper sheets P. The fixing unit 50 is provided with a heater roller 51 for heating the paper sheets P and a pressure roller 52 for pressing against the heater roller 51. Each of the heater roller 51 and the pressure roller 52 has a cylindrical shape, and the heater roller 51 is internally provided with a heat source such as a halogen lamp. A contact area called a fixing nip is formed between the heater roller 51 and the pressure roller 52, and the toner image is fused and fixated onto the paper sheets P while the paper sheets P are passed through the fixing nip. After the toner image has been secondarily transferred onto the paper sheets P, the toner remaining on the transfer belt 31 is recovered by a belt cleaning device (not shown).

The example image forming apparatus 1 includes discharge rollers 53 and 54 for discharging the paper sheets P on which the toner image has been fixed by the fixing unit 50 to the outside of the apparatus.

An example printing operation of the example image forming apparatus 1 is described. When an image signal of a recording image is input to the image forming apparatus 1, the image forming apparatus 1 may rotate the paper feed rolls 15*a*-15*d* to pick up and convey a paper sheet P from the stack in the cassette K. Then, the surface of the photosensitive body 40 is uniformly charged to a predetermined potential by the charge roller 41 (charging operation). After that, based on the received image signal, an electrostatic latent image may be formed on the surface of the photosensitive body 40 by irradiating laser light with the exposure unit 42 (exposing operation).

In the developing device 20, the electrostatic latent image is developed to form a toner image (developing operation). Thus formed toner image is primarily transferred from the photosensitive body 40 to the transfer belt 31 in the region at which the photosensitive body 40 faces the transfer belt 31 (transferring operation). The toner images formed on the four photosensitive bodies 40 are successively superposed to form a single composite toner image on the transfer belt 31. Then, in the secondary transfer region R2 at which the support roller 31*d* faces the secondary transfer roller 33, the composite toner image is secondarily transferred onto the paper sheet P conveyed from the recording medium conveyance unit 10.

The paper sheet P, with the secondarily transferred composite toner image, is conveyed to the fixing unit 50. The overlaid toner image is fused and fixated onto the paper sheet P while the paper sheet P is made to pass under heat and pressure between the heater roller 51 and the pressure roller 52 (fixing operation). After that, the paper sheet P is discharged to the outside of the image forming apparatus 1 by the discharge rollers 53 and 54.

Figure 2:
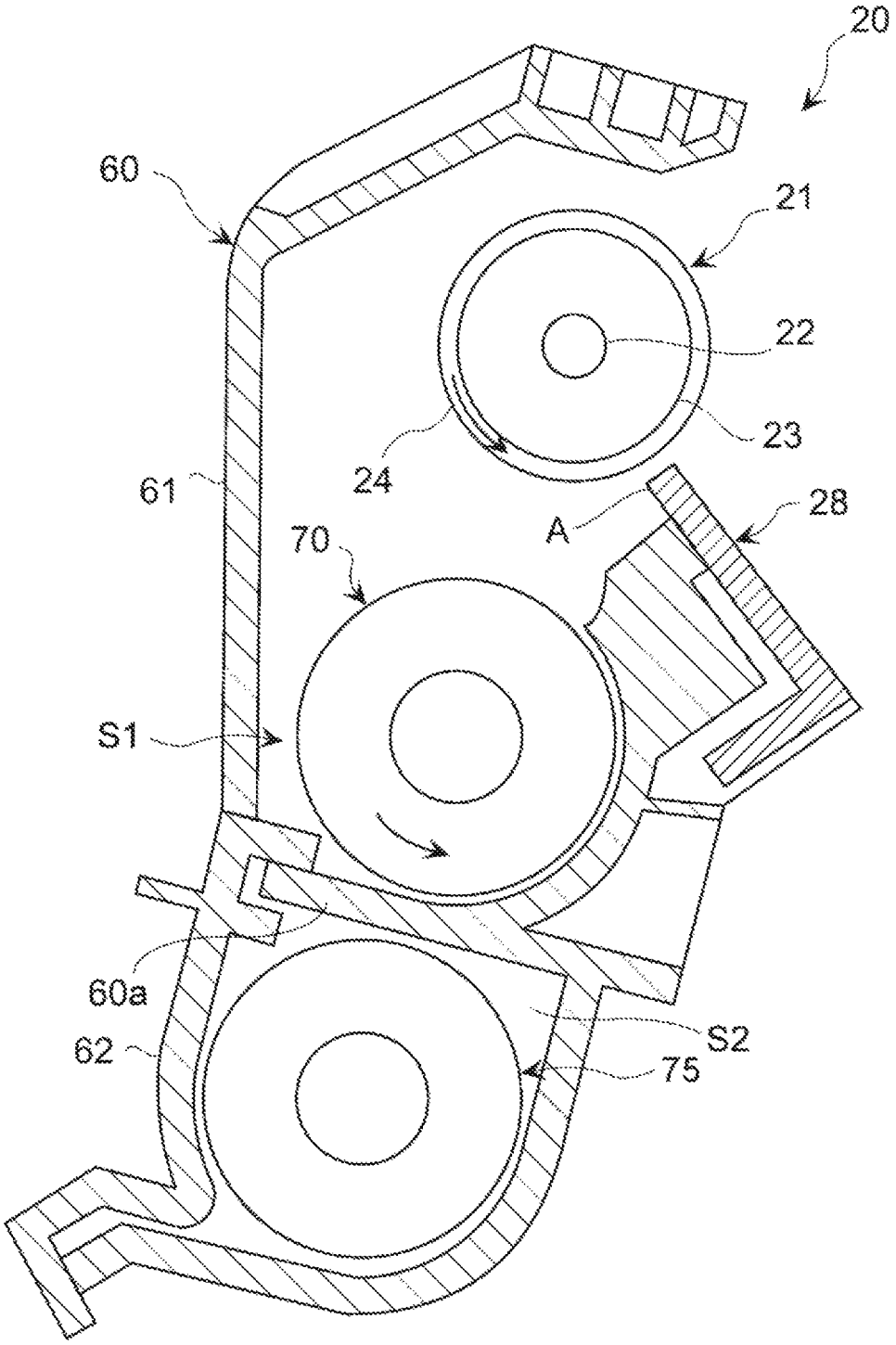
FIG. 2 is a cross-sectional view of an example developing device.
Figure 3:
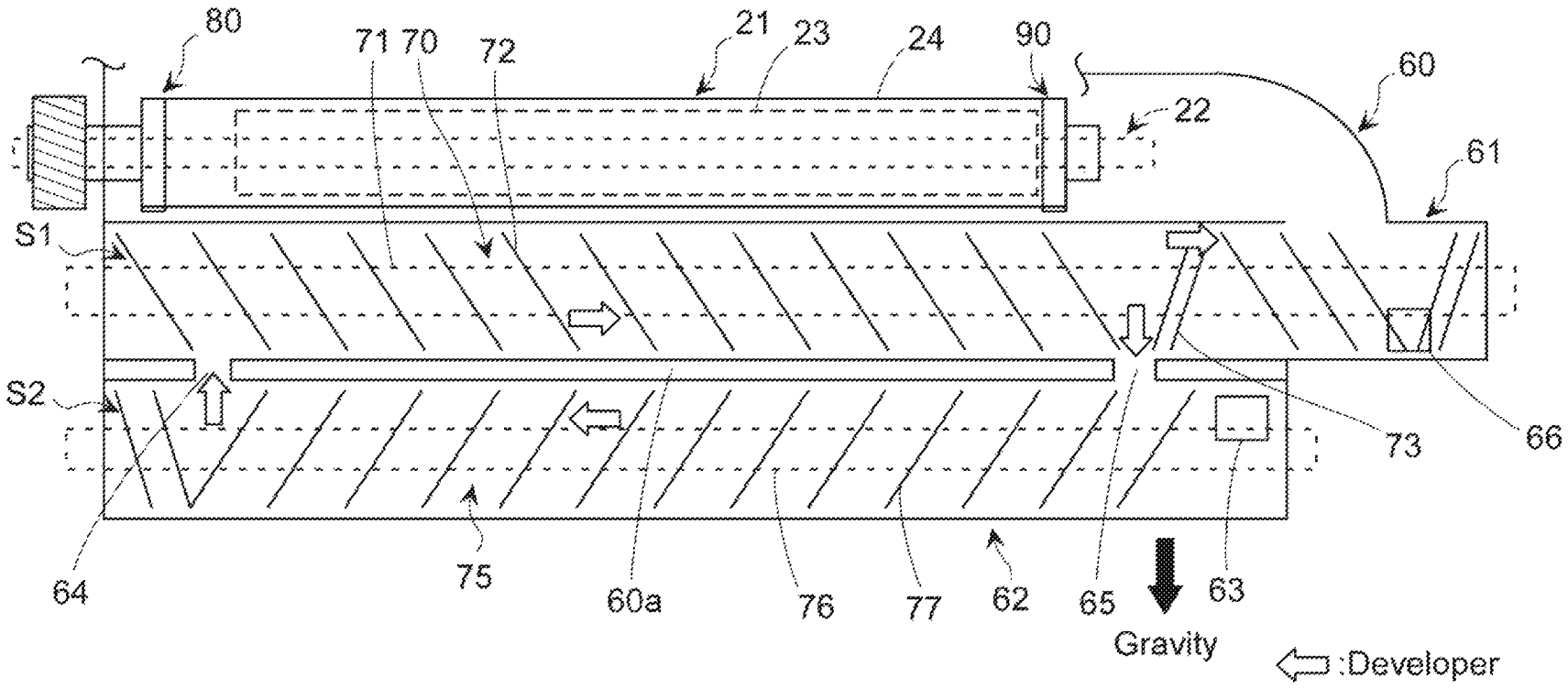
FIG. 3 is a schematic diagram of an interior of the example developing device of FIG. 2.

FIG. 2 shows a cross sectional view of an example developing device 20 provided with a doctor blade 28 as the layer regulating member. FIG. 3 is a schematic diagram of an overall structure of the interior of the example developing device 20. In the drawings, cross sections of the example developing device 20 may be illustrated in a position, where the example developing device 20 is mounted to the example image forming apparatus 1. FIG. 3 does not show the doctor blade 28. The developing device 20 may comprise a housing 60, the developer roller 21, the doctor blade 28, a first stir-and-transport member 70, and a second stir-and-transport member 75.

The housing 60 is a container having a longitudinal length that extends substantially horizontally. The housing 60 defines an internal space and has a partition 60*a* which divides the internal space vertically. In the housing 60, a first container chamber S1 is formed above the partition 60*a* and a second container chamber S2 is formed below the partition 60*a*. The developer roller 21 and the first stir-and-transport member 70 are disposed in the first container chamber S1. The second stir-and-transport member 75 is disposed in the second container chamber S2. In the housing 60, the part containing the first stir-and-transport member 70 constitutes a first housing part 61 and the part containing the second stir-and-transport member 75 constitutes a second housing part 62.

With reference to FIG. 3, the housing 60 may be formed with a developer supply port 63, a first opening 64, a second opening 65, and a developer discharge port 66. For example, the housing 60 may be formed with the first opening 64 in the vicinity of one longitudinal end thereof. The housing 60 is formed with the developer supply port 63, the second opening 65 and the developer discharge port 66 in the vicinity of the other longitudinal end.

The developer supply port 63 may be formed in the second housing part 62. The developer supply port 63 is an opening for sending the developer supplied from the toner tank N to the second container chamber S2. The developer includes a magnetic carrier and a non-magnetic toner.

The first opening 64 is formed in the partition 60*a*. The first opening 64 communicates the first container chamber S1 with the second container chamber S2. The first opening 64 is an opening for sending the developer transported by the second stir-and-transport member 75 to the first container chamber S1.

The second opening 65 is formed in the partition 60*a*. The second opening 65 is arranged between the first opening 64 and the developer discharge port 66. The second opening 65 communicates the first container chamber S1 with the second container chamber S2. The second opening 65 is an opening for sending the developer transported by the first stir-and-transport member 70 to the second container chamber S2.

The developer discharge port 66 is formed in the first housing part 61. The developer discharge port 66 is an opening for sending an excess of developer from the first container chamber S1 to a waste toner box (not shown).

The developer roller 21 may be a developer carrier for supplying toner to an electrostatic latent image formed on the circumferential surface of the photosensitive drum 40. The developer roller 21 is disposed in an upper part of the first container chamber S1 to face the photosensitive drum 40. The developer roller 21 may include a shaft 22, a magnet part 23, a developer sleeve 24, and a pair of flanges 80, 90. The shaft 22 and the magnet part 23 are fixed in the developer roller 21, and the developer sleeve 24 and the pair of flanges 80, 90 are driven to rotate together. The shaft 22 extends horizontally along the longitudinal direction of the housing 60. The ends of the shaft 22 are fixed/supported by the housing 60.

The magnet part 23 is fixed around the shaft 22. The magnet part 23 is a cylindrical member having a plurality of magnetic poles. In the magnet part 23, different magnetic poles are alternately arranged in a region facing the photosensitive drum 40. The magnet part 23 may exert a magnetic force on the circumferential surface of the developer sleeve 24 to carry the developer. The magnet part 23 causes the developer to rise into bristles that form a magnetic brush of the developer so that the magnetic brush comes in contact with or close to the electrostatic latent image on the photosensitive drum 40.

The developer sleeve 24 is a cylindrical member made of a non-magnetic metal. The developer sleeve 24 is formed in the shape of a cylinder. The developer sleeve 24 extends horizontally so as to be coaxial with the shaft 22 and the magnet part 23.

The pair of flanges 80, 90 include a first flange 80 provided at one axial end of the developer sleeve 24 and a second flange 90 provided at the other axial end of the developer sleeve 24.

The doctor blade 28 is a layer thickness regulating member for leveling the developer adhered on the outer circumferential surface of the developer sleeve 24 to obtain a layer of developer of uniform thickness. The doctor blade 28 is disposed on an upstream side along a developer transport direction of the developer sleeve 24, or the developer roller 21, relative to a position at which the developer sleeve 24, or the developer roller 21, most closely faces the photosensitive drum 40. The blade 28 may be made of a metal material such as stainless steel.

The first stir-and-transport member 70 may stir and mix the developer in the first container chamber S1 while transporting the developer. The developer stirred and mixed by the first stir-and-transport member 70 is supplied to the developer roller 21. Additionally, the developer transported by the first stir-and-transport member 70 may be returned to the second container chamber S2 via the second opening 65.

The first stir-and-transport member 70 may include a first support shaft 71 and a first transport blade 72. The first support shaft 71 extends horizontally along the partition 60*a*. The first support shaft 71 is rotatably supported by bearings (not shown). The first transport blade 72 is formed around the outer circumferential surface of the first support shaft 71. The first transport blade 72 has a sloped helical surface arranged along the axial direction of the first support shaft 71. The first transport blade 72 transports the developer a forward direction, from the side of the first opening 64 to the side of the second opening 65.

A counter blade 73 is formed on the outer circumferential surface of the first support shaft 71. The counter blade 73 is provided between the second opening 65 and the developer discharge port 66. The counter blade 73 is a portion that transports the developer in a direction opposite to the forward direction of the first transport blade 72. Accordingly, the counter blade 73 inhibits the developer between the first opening 64 and the second opening 65 from moving toward the developer discharge port 66. If the amount of the developer in the first container chamber S1 exceeds a predetermined amount, the excess developer is sent to the developer discharge port 66 over the counter blade 73. The excess developer sent to the developer discharge port 66 is collected into the waste toner box (not shown).

The second stir-and-transport member 75 may stir and mix the developer in the second container chamber S2 while transporting the developer. The developer stirred and mixed by the second transport member 75 may be supplied to the first container chamber S1 via the first opening 64.

The second stir-and-transport member 75 may include a second support shaft 76 and a second transport blade 77. The second support shaft 76 extends horizontally along the partition 60*a*. The second support shaft 76 is rotatably supported by bearings (not shown). The second transport blade 77 is formed around the outer circumferential surface of the second support shaft 76. The second transport blade 77 has a sloped helical surface arranged along the axial direction of the second support shaft 76. The second transport blade 77 transports the developer from the second opening 65 toward the first opening 64.

The two-component developer used with such developing device includes a magnetic carrier and a non-magnetic toner. When the developer is subjected to mechanical stress, the developer may deteriorate, for examples when toner is transferred onto the latent image of the photosensitive body. The deterioration of the developer may be classified into two types, deterioration due to stress on the carrier and deterioration due to stress on the toner.

The carrier may include an organic resin coating over the surface of ferrite powder (core material) having an average particle diameter of 20 to 50 μm. When such carrier is subjected to stress, the carrier may deteriorate due to the detachment of the organic resin coating or contamination of the carrier by additives of the toner.

The toner may comprise a binder resin, a colorant, a charge control agent, wax, an external additive and the like. The external additive is attached to the surface of the toner particles and plays a role in controlling the chargeability, fluidity, and anti-blocking property of the toner. When such toner is subjected to stress, the external additive may be detached from the toner particles and/or sink (e.g. become embedded) into the toner particles, thereby deteriorating the toner. Such deterioration of toner may reduce the fluidity, the chargeability, and the developing property of the developer. The reduced fluidity may impede in suitably charging the developer (e.g. cause difficulty in producing or achieving a predetermined or selected amount of charge) due to a reduced stirring and mixing (contact and separation) behavior of the toner and the carrier, thereby reducing the chargeability. Further, the reduced fluidity may change the bulk density which impedes density control by a toner density control system, thus making it difficult to achieve or maintain a constant ratio between the toner and the carrier. The lowering of chargeability may cause scattering of the toner and/or deficiencies in printed images, for example, white stripes or "backgrounds" which is a phenomenon in which toner is deposited on part of the paper sheet where printing is not intended. As for the reduced developing property, the embedding/detachment of the external additive of the toner may increase the physical absorption between the carrier and the toner, thus impeding the toner in the developer carried on the developer roller from transferring to the latent image on the circumferential surface of the photosensitive body, thereby reducing the image density.

To achieve high-speed printing in image forming apparatuses operating with electrophotographic system, the rotation speed of the developer roller 21 and the like may be increased, which in turn increases mechanical stress on the developer. To achieve low-temperature fixing, the toner should be softer, which renders the aforementioned external additive prone to detachment/embedding when subjected to stress, in turn generating the aforementioned printed image deficiency and the toner scattering, which limit the life span of the developer.

In the aforementioned example developing device, the developer is most subjected to mechanical stress when the developer adhered onto the outer circumferential surface of the developer sleeve 24 is compressed and layer-regulated by the doctor blade 28 to be formed into a layer with a uniform thickness.

Figure 4:
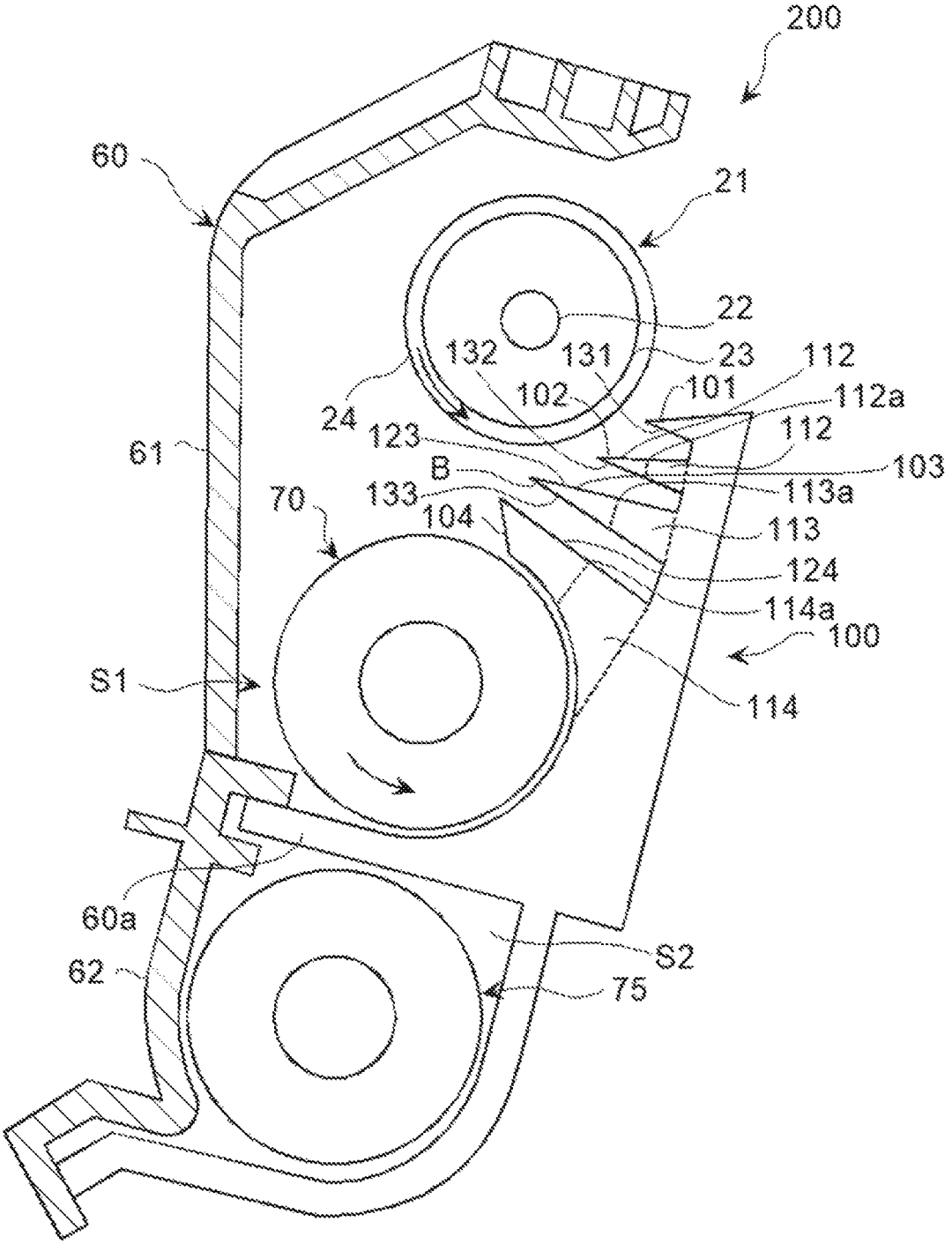
FIG. 4 is a cross-sectional view of an example developing device.
Figure 5:
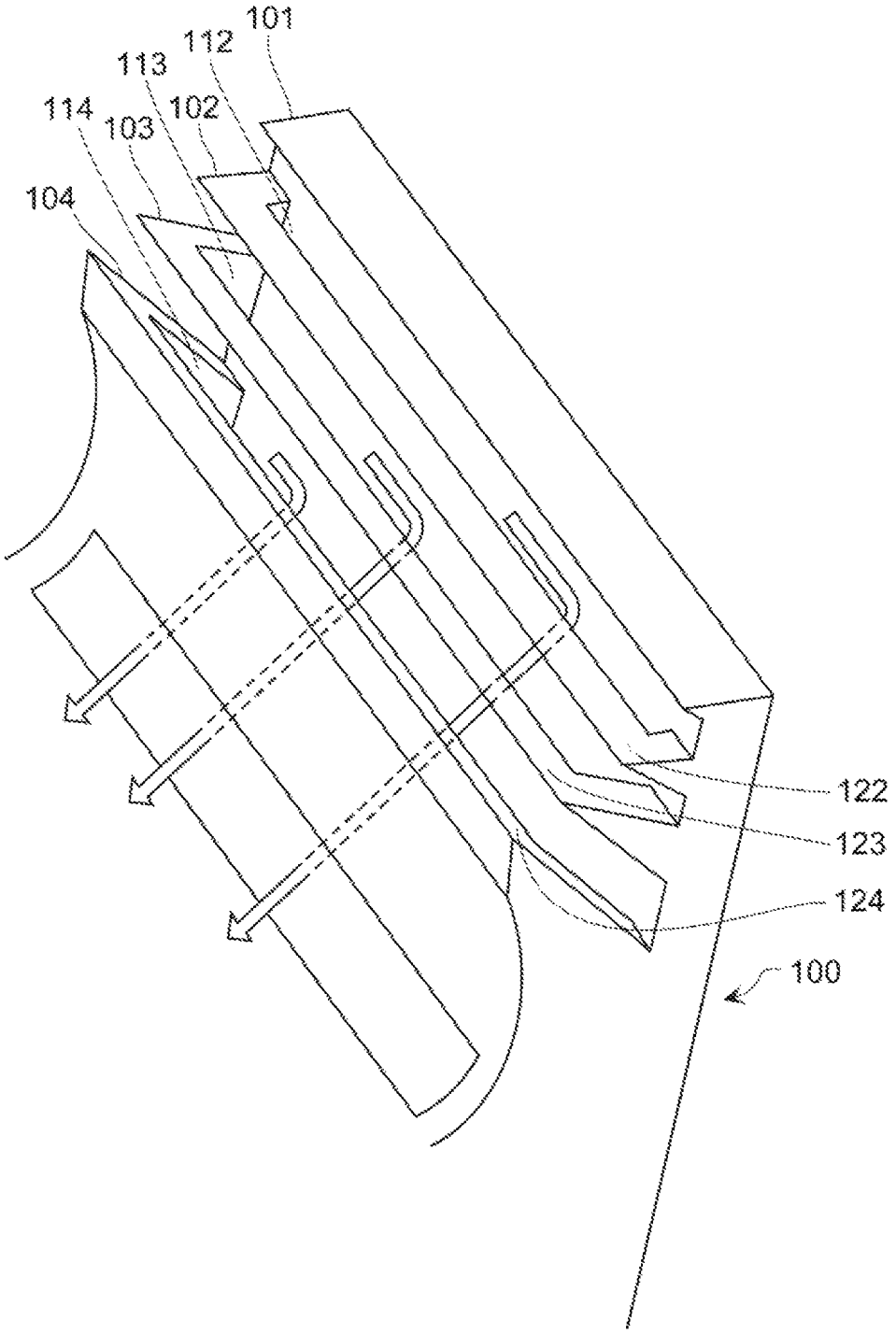
FIG. 5 is a perspective view of an example layer thickness regulating member.

FIG. 4 is a cross sectional view of a developing device 200 provided with an example layer thickness regulating member 100 constructed to reduce pressure acting on the developer, including mechanical stress on the developer, relative to the comparative doctor blade 28. FIG. 5 is a perspective view of the example layer thickness regulating member 100.

With reference to FIG. 4 and FIG. 5, the example layer thickness regulating member 100 may include a first blade 101, a second blade 102, and a third blade 103 disposed adjacent to each other along the outer circumferential surface of the developer roller, as well as a guide body 104, to shape the developer adhered or carried on the developer sleeve 24, i.e., the outer circumferential surface of the developer roller 21, in a stepwise manner (e.g., in stages), into a layer with a uniform thickness. The first blade 101 is disposed at an upstream side along the rotation direction of the developer roller 21 relative to a position at which the developer roller 21 most closely faces the photosensitive drum 40, i.e., an upstream side along the developer transport direction of the developer roller 21. The second blade 102 is positioned at an upstream side of the first blade 101 along the developer transport direction. The third blade 103 is positioned at an upstream side of the second blade 102 along the developer transport direction. Note that, while FIG. 4 shows that the first blade 101, the second blade 102, the third blade 103, and the guide body 104 are integrally formed as a single component, the first blade 101, the second blade 102, the third blade 103, and the guide body 104 may be formed as separate components. Further, the guide body 104 may be formed as part of the housing.

Figure 6:
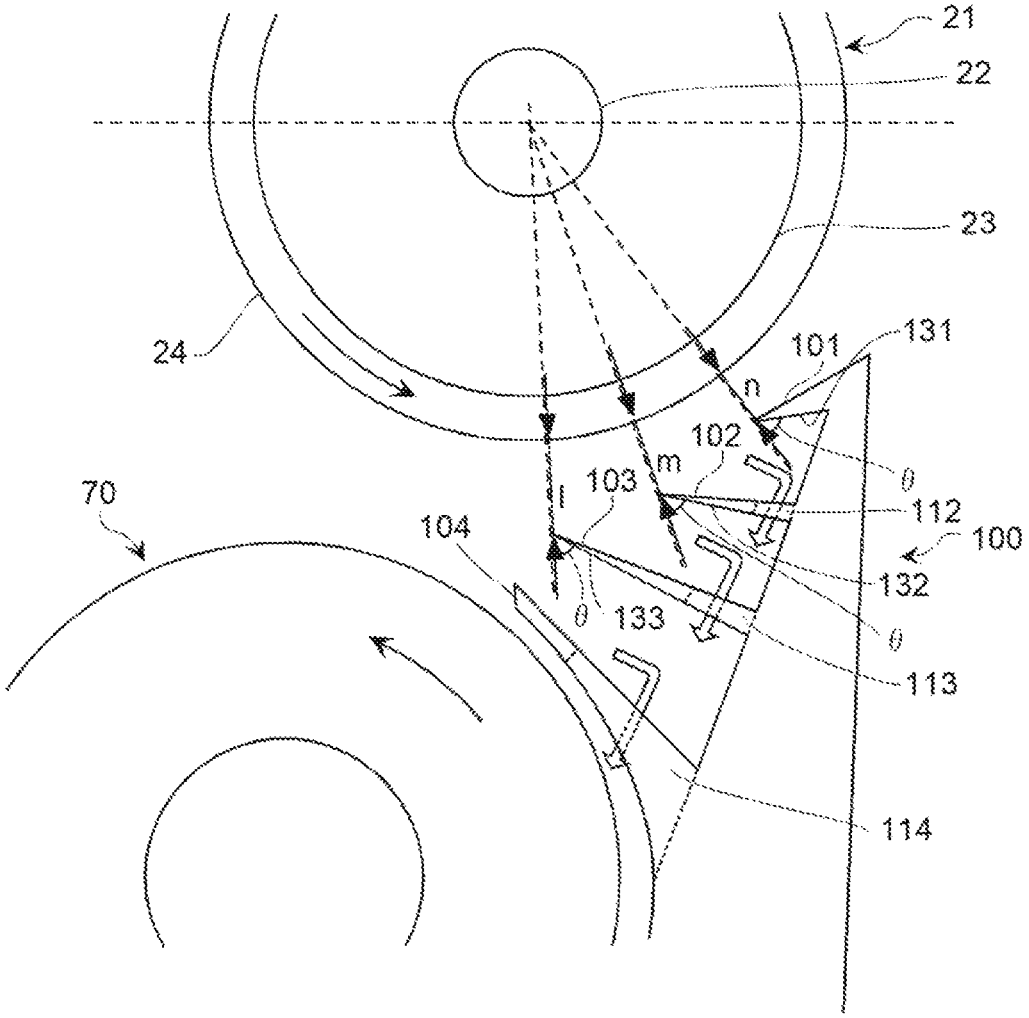
FIG. 6 is a cross-sectional view of an example developing device having an example layer thickness regulating member.

With reference to FIG. 6, a distance n represents a distance between the outer circumferential surface of the developer roller 21 and the distal edge of the first blade 101, a distance m represents a distance between the outer circumferential surface of the developer roller 21 and the distal edge of the second blade 102, and a distance l represents a distance between the outer circumferential surface of the developer roller 21 and the third blade 103. The distances n, m and n may be set to satisfy l>m>n. For example, l=500 μm, m=400 μm, and n=300 μm. Accordingly, the developer adhered onto the outer circumferential surface of the developer roller 21 is regulated stepwise (e.g. in stages) by the third blade 103, the second blade 102, and the first blade 101 to form a layer with a uniform thickness. Accordingly, the pressure acting on the developer can be reduced relative to the use of the comparable doctor blade 28. Each of the first blade 101, the second blade 102 and the third blade 103 in the example layer thickness regulating member 100, has an edge (also referred to as "distal edge") that is acute. Accordingly, the distal edges of the first blade 101, the second blade 102, and the third blade 103 are more sharpened than in the doctor blade 28, thereby further reducing the pressure acting on the developer. In some examples, the layer thickness regulating member 100, the second blade 102 and the third blade 103 are respectively provided with openings 112 and 113, as shown in FIG. 5, for further reducing the pressure acting on the developer.

Figure 7:
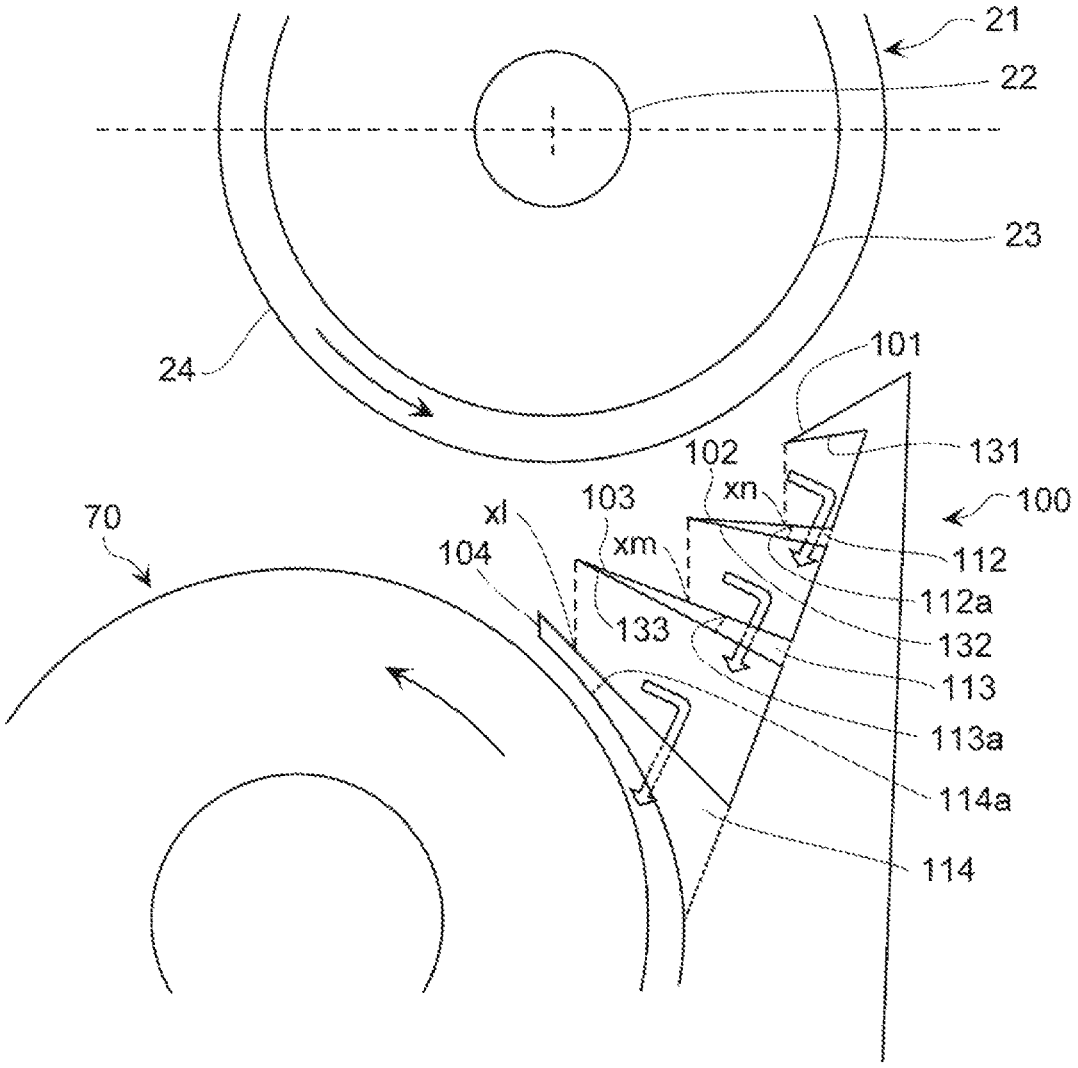
FIG. 7 is a cross-sectional view of an example developing device having an example layer thickness regulating member.

With reference to FIG. 7, the opening 112 has an opening edge 112*a* along the longitudinal direction of the developer roller 21 on a side closer to the developer roller 21. An intersection point xn is located where a vertical line drawn from the distal edge of the first blade 101 down to the second blade 102 intersects the second blade 102 (for example on the upper surface of the second blade 102). The opening edge 112*a* is positioned away from the developer roller 21 relative to the intersection point xn. Accordingly, the opening 112 is positioned away from the developer roller 21 relative to the intersection point xn that intersects the vertical line drawn from the distal edge of the first blade 101 down to the second blade 102.

The opening 113 has an opening edge 113*a* along the longitudinal direction of the developer roller 21 on a side closer to the developer roller 21. An intersection point xm is located where a vertical line drawn from the distal edge of the second blade 102 down to the third blade 103 intersects the third blade 103 (for example on the upper surface of the third blade 103). The opening edge 113*a* is positioned away from the developer roller 21 relative to the intersection point xm. Accordingly, the opening 113 is positioned away from the developer roller 21 relative to the intersection point xm that intersects the vertical line drawn from the distal edge of the second blade 102 down to the third blade 102.

The developer is carried onto the developer roller 21 encounters the third blade 103 which levels the developer to a uniform amount. The developer that remains on the developer roller 21 after passing the third blade 103 is subsequently leveled by the second blade 102, and the developer that remains after passing the second blade 102 is subsequently leveled by the first blade 101. For example, the developer adhered and held onto the outer circumferential surface of the developer roller 21 is leveled (or regulated/controlled) by the distal edge of the third blade 103 in terms of the amount of passage (height of the bristles of developer) and transferred toward the second blade 102. The developer having passed through the third blade 103 is regulated (e.g., controlled) by the distal edge of the second blade 102, again in terms of the amount of passage, and transferred toward the first blade 101, and the developer having passed through the second blade 102 is regulated (e.g., controlled) by the distal edge of the first blade 101, once again in terms of the amount of passage, and transferred to a position at which the developer roller 21 most closely faces the photosensitive drum 40.

The excess developer that has failed to pass past (e.g., that has been blocked by) the distal edge of the first blade 101 drops by gravity toward the second blade 102. The excess developer that has dropped toward the second blade 102 slides down a sloping surface 122 of the second blade 102, passes through the opening 112 in the second blade 102, and drops by gravity toward the third blade 103. The excess developer that has failed to pass past (e.g., that has been blocked by) the distal edge of the second blade 102 drops by toward the third blade 103. The excess developer that has dropped toward the third blade 103 slides down a sloping surface 123 of the third blade 103, passes through the opening 113 in the third blade 103, and drops toward the guide body 104. Further, the excess developer that has failed to pass past (e.g., that has been blocked by) the distal edge of the third blade 103 drops by gravity toward the guide body 104.

The guide body 104 includes a hole 114 that directs excess developer toward an upstream position along the rotation direction of the first stir-and-transport member 70 relative to the position at which the developer is supplied from the first stir-and-transport member 70 to the developer roller 21. The hole 114 has a hole edge 114*a* along the longitudinal direction of the developer roller 21 on a side closer to the developer roller 21. An intersection point xl is located where a vertical line drawn from the distal edge of the third blade 103 down to the guide body 104 intersects the guide body 104 (for example an upper surface of the guide body 104). The hole edge 114*a* is positioned away from the developer roller 21 relative to the intersection point xl. Accordingly, the hole 114 is positioned away from the developer roller 21 relative to the intersection point xl that intersects the vertical line drawn from the distal edge of the third blade 103 down to the guide body 104. The excess developer that has dropped toward the guide body 104 slides down a sloping surface 124 of the guide body 104, passes through the hole 114, and drops toward the first stir-and-transport member 70. The aforementioned flows of the excess developer are diagrammatically shown in the drawings by white blank arrows.

The provision of the openings 112 and 113 in the second blade 102 and the third blade 103, respectively, and the provision of the hole 114 in the guide body 104 enable to prevent excess developer from lodging and/or accumulating between the guide body 104 and the third blade 103, between the third blade 103 and the second blade 102, and between the second blade 102 and the first blade 101, and pressure or stress acting on the developer can be better reduced.

Figure 9:
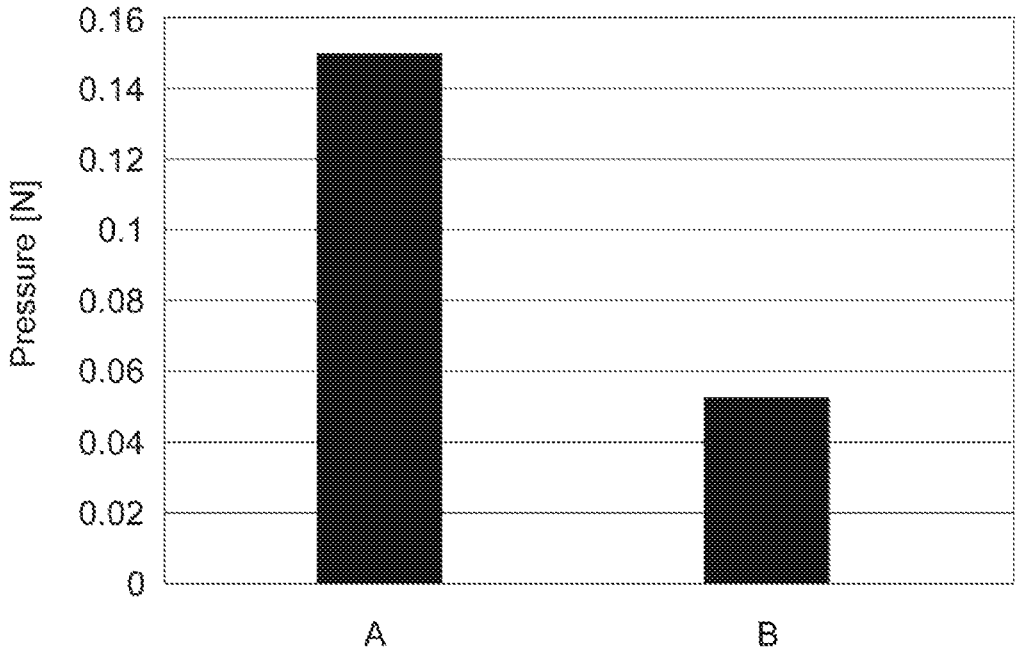
FIG. 9 is a graph showing results of a comparison of pressures acting on developer.

Pressure acting on the developer was compared between the example developing device 20 provided with the doctor blade 28 as shown in FIG. 2 and the example developing device 200 provided with the example layer thickness regulating member 100 as shown in FIG. 4. Load cells (LCL-113G available from OMEGA Engineering, Inc.) were disposed in a portion of the doctor blade indicated as A in FIG. 2 and in a portion of the third blade 103 of the example layer thickness regulating member 100 indicated as B in FIG. 4, respectively, and the pressure acting on the developer was measured. The linear speed of the developer roller was 850 mm/s, the room temperature was 20° C., the relative humidity was 50%, and the toner density was 9%. The results of the measurement are shown in FIG. 9. A indicates the pressure measured when the doctor blade 28 was used, and B indicates the pressure measured when the layer thickness regulating member 100 was used. The graph of FIG. 9 indicates that, when the example layer thickness regulating member 100 was used, the pressure acting on the developer at the layer thickness regulating member was reduced to about ⅓ as compared with the use of the doctor blade 28.

Figure 10:
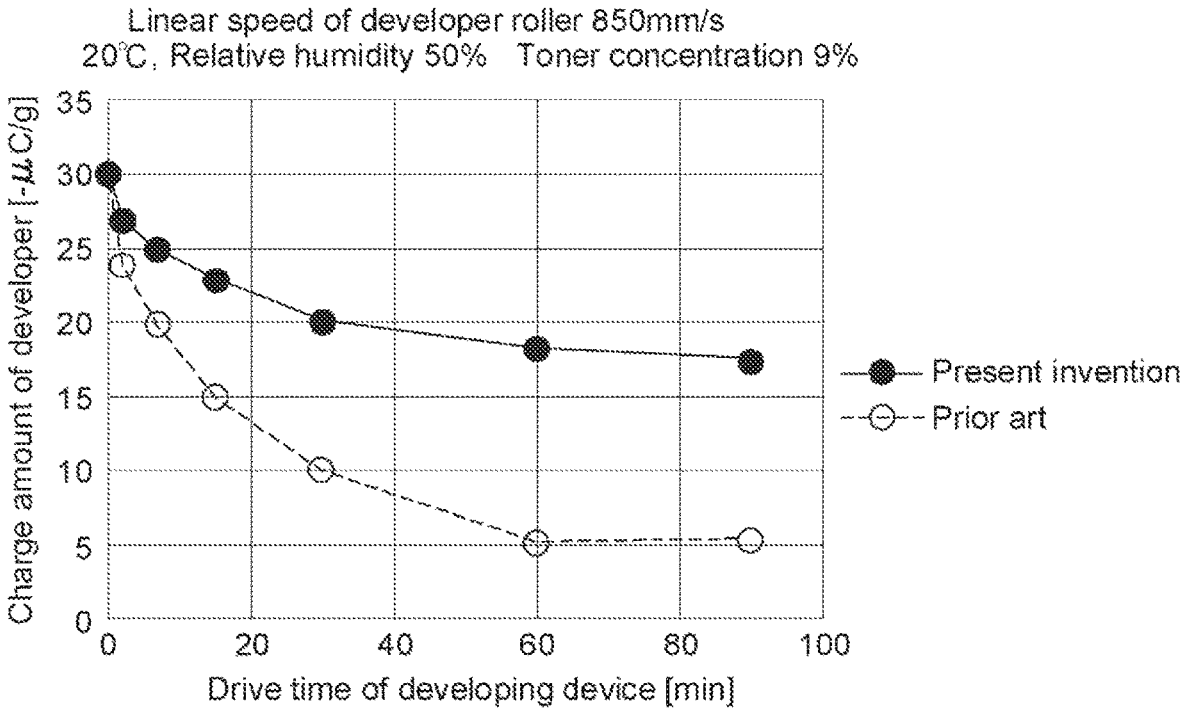
FIG. 10 is a graph showing transitions of charged amounts of developer relative to driving time length of an example developing device.

Further comparison was made between the developing device 20 provided with the doctor blade 28 as shown in FIG. 2 and the developing device 200 provided with the example layer thickness regulating member 100 as shown in FIG. 4, in terms of charge amount of developer that affects image quality. The charge amount of developer is one of various evaluation factors that represent or are indicative of a degree of degradation of developer, and the charge amount is known to gradually decrease as the developer deteriorates. The condition of measurement is the same as that for the aforementioned comparison of pressure acting on the developer. Further, the charge amount was measured with an absorption-type charge amount analyzer 210HS-2A available from Trek, Inc. Changes in charge amount of developer relative to drive time of the developing device are shown in FIG. 10. As may be seen from FIG. 10, in the developing device 20 provided with the doctor blade 28, the charge amount dropped to −5 μC/g after 60 minutes. In contrast, in the example developing device 200 provided with the layer thickness regulating member 100, the charge amount was kept at −18 μC/g after 60 minutes, which indicates that the use of the example layer thickness regulating member 100 reduces mechanical stress on the developer and suppresses the deterioration of the developer, as compared with the case where the doctor blade 28 was used.

Figure 8:
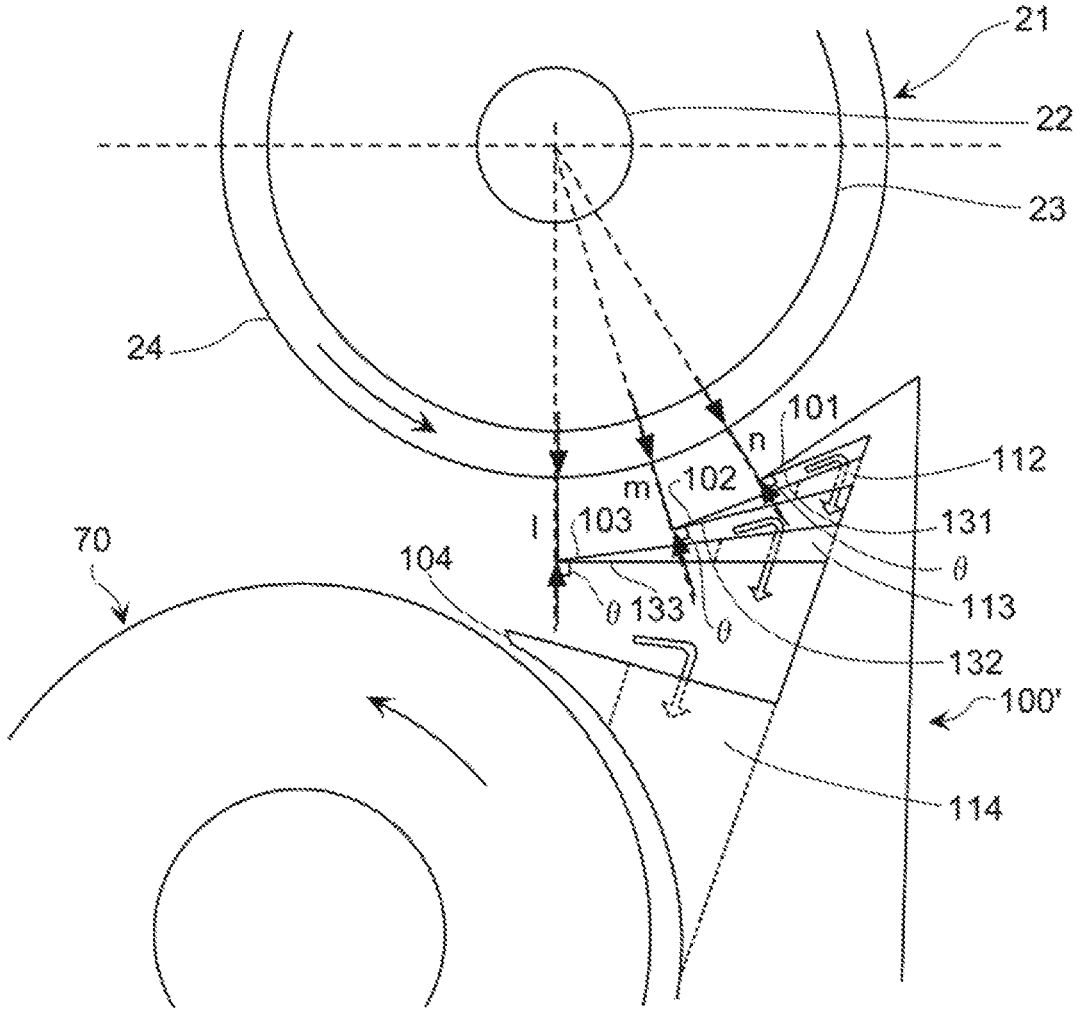
FIG. 8 is a cross-sectional view of an example developing device having an example layer thickness regulating member.
Figure 11:
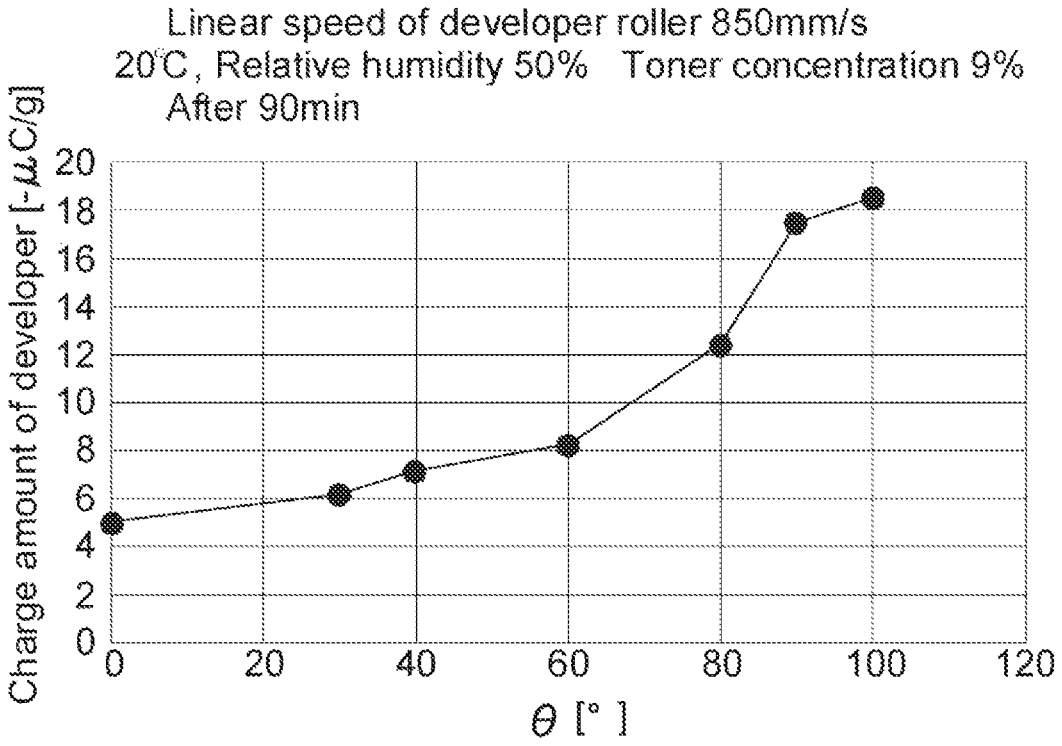
FIG. 11 is a graph showing a relationship between angles at which developer enters a layer thickness regulating member and charged amounts of developer.

With reference to FIG. 6, the first blade 101, the second blade 102 and the third blade 103, have respective developer-regulating surfaces 131, 132 and 133. The developer-regulating surfaces 131, 132 and 133 form equal angles 8 with respective radial lines extending from a central rotation axis of the developer roller 21 and intersecting the respective distal edges of the first blade 101, the second blade 102 and the third blade 103. For example, the angles formed by respective virtual lines extending radially from the central axis of the developer roller to intersect with the respective distal edges of the first blade 101, the second blade 102 and the third blade 103, and developer-regulating surfaces 131, 132 and 133 of the first blade, the second blade 102 and the third blade 103 are the same θ degrees. The angle θ may represent an angle at which the developer enters or moves toward the layer thickness regulating member. FIG. 11 shows a relationship between the angle θ and the charge amount of the developer corresponding to the angle θ. The charge amount of the developer is represented by values of the charge amount of the developer measured after driving the developing device for 90 minutes. In the example of FIG. 2, the doctor blade is oriented radially with respect to the developer roller 21 and forms a 0° angle with a radial extending from the rotation axis of the developer roller 21. FIG. 11 shows that the charge amount of the developer was maintained higher when θ was larger than 0°, and that mechanical stress on the developer was decreased. FIG. 11 shows a non-linear correlation between the angle θ and the charge amount, and that the effect is increased when θ reaches 60° or more. Accordingly, in some examples, the angle θ is set to 60° to 100°. FIG. 8 shows an example layer thickness regulating member 100' where the angle θ is 90°.

It is to be understood that not all aspects, advantages and features described herein may necessarily be achieved by, or included in, any one particular example. Indeed, having described and illustrated various examples herein, it should be apparent that other examples may be modified in arrangement and detail.

For example, while the some examples describe that the layer thickness regulating member 100 is provided with the three blades 101 to 103, the number of blades may be 2 or 4 or more. In such examples, the blade positioned on the most downstream side along the rotation direction of the developer roller may be formed without any opening.

The invention claimed is:

1. A developing device comprising:

a developer roller having an outer circumferential surface to carry developer;

a rotatable stir-and-transport member to supply developer to the developer roller; and a layer thickness regulating member disposed in a stepwise manner along a developer transport direction of the developer roller to remove excess developer in stages so that the developer carried on the outer circumferential surface of the developer roller is made to have a uniform thickness, and the layer thickness regulating member includes a guide part to direct the excess developer back to the stir-and-transport member.

2. The developing device according to claim 1, wherein the layer thickness regulating member includes at least a first blade and a second blade disposed adjacent the first blade, wherein the first blade and the second blade are spaced apart adjacent to the outer circumferential surface of the developer roller, wherein the first blade is positioned on a downstream side of the second blade along a developer transport direction of the developer roller, and wherein the guide part comprises an opening formed in the second blade.

3. The developing device according to claim 2, wherein the first blade has a developer-regulating surface and a distal edge, wherein the second blade has a developer-regulating surface and a distal edge, and wherein respective virtual lines extending radially from a central axis of the developer roller to intersect with the respective distal edges of the first blade and the second blade, form respective angles of 60 degrees or more with the respective developer-regulating surfaces of the first blade and the second blade.

4. The developing device according to claim 2, wherein the opening in the second blade is positioned away from the developer roller relative to an intersection point located where a vertical line extending from the distal edge of the first blade to the second blade intersects the second blade.

5. The developing device according to claim 2, comprising a third blade disposed adjacent to the second blade on an upstream side of the second blade along the developer transport direction, wherein the third blade includes an opening positioned away from the developer roller relative to an intersection point located where a vertical line extending from the distal edge of the second blade to the third blade intersects the third blade.

6. The developing device according to claim 2, wherein the guide part includes a guide body having a hole to direct the excess developer toward an upstream position along a rotation direction of the stir-and-transport member relative to a position at which the developer is supplied from the stir-and-transport member to the developer roller.

7. The developing device according to claim 6, wherein the hole of the guide body is positioned to cause the excess developer guided through the opening of the second blade to drop through the hole toward the stir-and-transport member.

8. The developing device according to claim 6, comprising a third blade disposed adjacent to the second blade on an upstream side of the second blade along the developer transport direction, wherein the hole in the guide body is positioned away from the developer roller relative to an intersection point located where a vertical line extending from a distal edge of the third blade intersects the guide body.

9. A developing device comprising:

a developer roller to carry developer to a photosensitive body;

a stir-and-transport member to supply the developer to the developer roller; and a layer thickness regulating member located adjacent the developer roller, the layer thickness regulating member disposed in a stepwise manner along a developer transport direction of the developer roller to limit a layer thickness the developer carried on the developer roller by removing excess developer in stages, and the layer thickness regulating member including a guide part to direct the excess developer to the stir-and-transport member.

10. The developing device according to claim 9, the developer roller to rotate in a rotational direction, wherein the layer thickness regulating member includes a first blade and a second blade, wherein the first blade is positioned on a downstream side of the second blade in the rotational direction of the developer roller, and wherein the guide part comprises an opening in the second blade to guide the excess developer removed from the developer roller by the first blade and the second blade.

11. The developing device according to claim 10, wherein the first blade has a developer-regulating surface to remove a first portion of the excess developer from the developer roller and a distal edge along an edge of the developer-regulating surface that is closest to the developer roller, wherein the second blade has a developer-regulating surface to remove a second portion of the excess developer from the developer roller and a distal edge along an edge of the developer-regulating surface that is closest to the developer roller, wherein a first virtual line extends radially from a rotational axis of the developer roller to the distal edge of the first blade and a second virtual line extends radially from the rotational axis of the developer roller to the distal edge of the second blade, wherein the developer-regulating surface of the first blade forms an angle of 60 degrees or more with the first virtual line, and wherein the developer-regulating surface of the second blade forms an angle of 60 degrees or more with the second virtual line.

12. The developing device according to claim 11, wherein the opening in the second blade is positioned further away from the developer roller than an intersection point located where the second blade is intersected by a vertical line extending from the distal edge of the first blade to the second blade.

13. The developing device according to claim 10, comprising a third blade located on an upstream side of the second blade along the rotational direction of the developer roller, wherein the third blade has an opening, wherein an intersection point is located where the third blade is intersected by a vertical line extending from the distal edge of the second blade to the third blade, and wherein the intersection point is located between the developer roller and the opening in the third blade.

14. The developing device according to claim 9, wherein the guide part comprises a guide body having a hole to direct the excess developer toward an upstream position along a transportation direction of the stir-and-transport member relative to a supply position at which the developer is supplied from the stir-and-transport member to the developer roller.

15. The developing device according to claim 14, comprising a third blade located on an upstream side of the second blade along the rotational direction of the developer roller, wherein an intersection point is located where the guide body is intersected by a vertical line extending from a distal edge of the third blade to the guide body, and wherein the intersection point is located between the hole of the guide body and the developer roller.

* * * * *